United States Patent [19]

Keane

[11] Patent Number: 4,832,833

[45] **Date of Patent: * May 23, 1989**

[54] FORMATION OF MEMBRANE-LIKE MATERIAL

[75] Inventor: James Keane, York, Pa.

[73] Assignee: Linnola Ltd., Dublin, Ireland

[ * ] Notice: The portion of the term of this patent subsequent to Sep. 9, 2003 has been disclaimed.

[21] Appl. No.: 51,319

[22] Filed: May 19, 1987

Related U.S. Application Data

[60] Continuation of Ser. No. 875,928, Jun. 19, 1986, Pat. No. 4,698,148, which is a division of Ser. No. 765,111, Aug. 13, 1985, Pat. No. 4,610,729, which is a continuation-in-part of Ser. No. 661,719, Oct. 17, 1984, Pat. No. 4,704,200, which is a continuation of Ser. No. 274,433, Jun. 17, 1981, abandoned.

[51] Int. Cl.[4] ..... C10G 1/04

[52] U.S. Cl. ..... 208/390; 208/391

[58] Field of Search ..... 208/390, 391

[56] References Cited

U.S. PATENT DOCUMENTS

| | | | |
|---|---|---|---|
| 4,610,729 | 9/1986 | Keane | 134/25.1 |
| 4,698,148 | 10/1987 | Keane | 208/390 |
| 4,704,200 | 11/1987 | Keane | 208/390 |

*Primary Examiner*—Asok Pal

*Attorney, Agent, or Firm*—Charles E. Brown; Charles A. Brown

[57] ABSTRACT

A membrane-like material forming component is obtained by dissolving material crude oil, bitumen or an amphipathic lipid in a solvent to form a solution thereof, the solvent being selected from the group consisting of halogenated hydrocarbons and p-xylene and being capable of forming in the presence of water and the oil, bitumen or amphipathic lipid and interfacial membrane-like material. Water is then admixed so as to cause the membrane-like material to form and the solution, water and membrane-like material are allowed to separate by relative densities, thereby forming a bottom layer of the solution, a top layer of water and an intermediate layer between the bottom and top layers, the intermediate layer comprising the membrane-like material. The membrane-like material is extended into the top layer of water from which it is isolated. The membrane-like material upon being brought into air dissociates and leaves a component derived from the oil, bitumen or amphipathic lipid and which is active to form or regenerate membrane-like material, when recombined with the solvent and water.

9 Claims, No Drawings

FORMATION OF MEMBRANE-LIKE MATERIAL

This application is a continuation of co-pending application Ser. No. 875,928 filed June 19, 1986, now U.S. Pat. No. 4,698,148, which is a division of application Ser. No. 765,111 filed Aug. 13, 1985, now U.S. Pat. No. 4,610,729, which is in turn a continuation-in-part of co-pending application Ser. No. 661,719 filed Oct. 17, 1984, now U.S. Pat. No. 4,704,200, which is in turn a continuation of application Ser. No. 274,433 filed June 17, 1981 and now abandoned.

The present invention relates to a method of removing chlorine-based contaminants such as dioxin (e.g. TCDD or 2,3,7,8-tetrachlorodibenzo-p-dioxin), PCB (polychlorinated biphenyl), DDT and chlordane, from materials contaminated with same. The invention is particularly directed to the decontamination of dioxin contaminated soils.

The decontamination of numerous sites contaminated with dioxin in the United States and elsewhere is presently on hold pending the development of a suitable clean-up method. Dioxin is typically found in the parts per million to parts per billion range and is tightly bound to the soil. It is highly hydrophobic, which accounts for its lack of mobility in the soil, except where the soil itself is moved such as in the case of rainwater runoff or erosion.

The toxicity and uncertainty about long term effects of exposure to dioxins have combined to make work in them very difficult. The analysis for dioxins is still at the frontiers of analytical chemistry, with new techniques still being developed.

Applicant has described in the aforesaid application Ser. No. 661,719 a method of separating oil or bitumen from a surface of a substrate covered with same, by first dissolving the oil or bitumen in a solvent to form a solution thereof. Water is then intimately contacted with the surface of the substrate, the solvent and water being capable of forming together in the presence of the oil or bitumen an interfacial membrane-like material which has a water side and is impermeable to the oil or bitumen. The intimate contacting of the water with the surface of the substrate causes the membrane-like material to form at the surface of the substrate with the water side oriented toward the surface while the water wets the surface and spreads thereover, the water displacing the membrane-like material away from the surface as it is being formed thereacross to thereby separate the solution from the surface and cover the surface with a layer of water. The membrane-like material acts as a barrier to maintain the oil or bitumen in the solution and to prevent passage of same into the water layer.

The solvent is selected for its ability to dissolve the oil or bitumen and to form a membrane-like material in the presence of the oil or bitumen and water. As examples of suitable solvents, the halogenated hydrocarbons can be mentioned. Among these, the chlorinated hydrocarbons such as methylene chloride, chloroform, trichloroethylene and perchlorethylene and the fluorinated hydrocarbons such as those available under the trademark FREON, particularly FREON TF (trichlotrifluoroethane), have given excellent results. A solvent which is not halogenated, p-xylene, has also been found to give results similar to methylene chloride. However, other hydrocarbon solvents such as m-xylene, o-xylene, gasoline, kerosene, naphtha and ether, which are conventionally used for extracting oil from bituminous sands or other oil-bearing materials, do not form the desired membrane-like material.

Applicant's earlier method is based on the in situ formation of a membrane-like material which involves the few molecular layers of oil or bitumen and solvent adjacent to the surface of the substrate, which are incorporated into the membrane-like material as it is being formed, leaving the actual molecular surface exposed to wetting by the water, with no residual solvent or oil on it. In other words, since the solvent is selected to form membrane-like material, it will form the membrane-like material using the oil or bitumen at the surface of the substrate and the water which is introduced by the wetting of the surface, thus entirely removing the oil or bitumen with the solvent and leaving a water-wet surface.

It has now been found, quite surprisingly, that an active component of the membrane-like material can be extracted therefrom and that the extracted membrane-like material forming component can be used to effectively remove chlorine-based contaminants from materials contaminated with same.

It is therefore an object of the present invention to provide a method of removing chlorine-based contaminants from materials contaminated with same, allowing such contaminants to be concentrated for easy disposal.

In accordance with a first aspect of the invention, there is provided a method of separating a chlorine-based contaminant from a surface of a substrate covered with same, which comprises dissolving the contaminant in a first solvent to form a solution thereof and admixing a further solution consisting of a membrane-like material forming component derived from mineral crude oil, bitumen or amphipathic lipids in a second solvent selected from the group consisting of halogenated hydrocarbons and p-xylene, the second solvent being miscible with the first solvent and capable of forming in the presence of water and the membrane-like material forming component an interfacial membrane-like material which has a water side and is impermeable to the contaminant. Water is then intimately contacted with the surface of the substrate so as to cause the membrane-like material to form at the surface of the substrate with the water side oriented toward the surface while the water wets the surface and spreads thereover, the membrane-like material incorporating during its formation the contaminant and mixture of solvents adjacent the surface, and the water displacing the membrane-like material away from the surface as it is being formed thereacross to thereby separate the contaminant and mixture of solvents from the surface and cover the surface with a layer of water. The membrane-like material acts as a barrier to maintain the contaminant in solution with the mixture of solvents and to prevent passage of same into the water layer.

According to a second aspect of the invention, there is also provided a method of removing a chlorine-based contaminant from a solution containing the contaminant dissolved in a first solvent, which comprises adding to the solution a further solution consisting of a membrane-like material forming component derived from mineral crude oil, bitumen or amphipathic lipids in a second solvent selected from the group consisting of halogenated hydrocarbons and p-xylene, the second solvent being miscible with the first solvent and capable of forming in the presence of water and the membrane-like material forming component an interfacial membrane-like material. Water is then added and the combined solutions and water are intimately mixed so as to cause the membrane-like material to form, and to generate sufficient array of the membrane-like material so as to absorb the contaminant, thereby removing same. The mixture of solvents, water and membrane-like material with absorbed contaminant are allowed to separate by relative densities and the membrane-like material containing the contaminant absorbed therein is thereafter isolated.

The first solvent is selected for its ability to form a solution of the contaminant, whereas the second solvent is selected for its ability to form the desired membrane-like material in the presence of water and the membrane-like material forming component. The second solvent must of course also be miscible with the first solvent.

Examples of suitable solvents which may be used to dissolve the contaminant are hexane, toluene, o-xylene, m-xylene, ether, gasoline, kerosene, fuel oil and naphtha. On the other hand, as second solvent that will form membrane-like material, use can be made of methylene chloride, chloroform, trichloroethylene, perchlorethylene, carbon tetrachloride, dichlorodifluoromethane, trichlorofluoromethane, trichlorotrifluoromethane and p-xylene.

It is also possible to use as first solvent a solvent that will form membrane-like material, to dissolve the contaminant. However, care must be taken to avoid the simultaneous presence of water and any membrane-like material forming component when such a solvent is added since it will result in the formation of membrane-like material in an undesirable condition and thus hinder the method. This particular care is applicable only when the contaminant is removed from a substrate or solid material, and does not apply in the case where the contaminant is removed from a solution thereof. Moreover, it is apparent that when using the second type of solvent to dissolve the contaminant, the membrane-like material forming component need not be in solution, but can be added as such directly to the solution of contaminant.

The membrane-like material forming component is preferably obtained by dissolving mineral crude oil, bitumen or an amphipathic lipid such as cholesterol in a solvent to form a solution thereof, the solvent being of the second type mentioned above, that is, selected from the group consisting of halogenated hydrocarbons and p-xylene and capable of forming in the presence of water and the oil, bitumen or amphipathic lipid an interfacial membrane-like material. Water is then admixed so as to cause the membrane-like material to form and the solution, water and membrane-like material are allowed to separate by relative densities. Since the solution of oil, bitumen or amphipathic lipid has a density greater than 1.0, there will be formed a bottom layer of the solution, a top layer of water and an intermediate layer between the bottom and top layers, the intermediate layer comprising the membrane-like material. As the membrane-like material is more stable in water than in solvent, it is extended into the top layer of water from which it can be easily isolated; this can be done for instance by blowing air into the solution and allowing the air bubbles to rise up through the intermediate layer comprising the membrane-like material, thereby extending the membrane-like material into long tethers in the top layer of water from which the tethers may be conveniently gathered and removed by means of a wire brush. Upon bringing the membrane-like material into air, it dissociates due to the evaporation of its solvent component, leaving water and a component derived from the oil, bitumen or amphipathic lipid and which is active to form or regenerate membrane-like material, whenever recombined with water and the appropriate solvent.

Upon redissolving the extracted component of the membrane-like material into a solvent of the type used for the formation of the membrane-like material and admixing water, the process can be repeated so as to form new membrane-like material and allow the extract to be recovered a second time to produce a more pure active component which forms the membrane-like material under the correct conditions. After several such extractions, the result is a white semi-solid material.

The membrane-like material has a water side and an oily side, and is impermeable to oil, bitumen and chlorine-based contaminants. It thus acts as a barrier to isolate such materials remote from the substrate from which these came, and to prevent their return to the substrate.

The membrane-like material is so-called because it consists of an agglomeration of molecules held together by coulombic forces only. The membrane-like material forming component used in the practice of the present invention appears to be the fossilized remains of the lipidic membrane or bacteria. Amphipathic lipids have one part of their molecule as a hydrocarbon, which will dissolve only in a non-polar solvent, while the other part of the molecule is polar and will dissolve only in a polar solvent such as water. Two fossilized members of this class of amphipathic lipids have been discovered in crude ol, bitumen and coal, and they are cholestane and bacteriohopane, being the fossilized remians of cholesterol and bacteriohopanetetrol respectively. The oily compounds found in crude oil and bitumen consist almost entirely of the bacterial debris of these two materials, plus the separated heads and tails of phospholipids, appearing as steroids, and fragments thereof. In the fossilizing process, the cholesterol and bacteriohopanetetrol have lost their hydrophilic portions consisting of oxygen and hydrogen pairs, and gained other materials instead, leaving the fossilized molecule hydrophobic instead of hydrophilic. In addition, these molecules may have gained a coulombic bond with the oxygen sites on silica, the major constituent of sand with which oily compounds are usually found to be associated. The semi-solid extract derived from crude oil and used in the practice of the invention is most likely a mixture of these materials.

When starting from a contaminated substrate, the contacting of water with the surface of the substrate, referred to in the method according to the first aspect of the invention, can be effected by simple mechanical agitation of the combined solutions, water and substrate together. Where the substrate is in granular form, such as sand grains, a mixer or attrition mill can be used to provide grinding and tumbling of the sand grains. The grinding action of the grains rubbing against each other provides many opportunities for the water to contact the surfaces of the grains and immediately spread thereacross, and also for a sand grain already covered with a layer of water to transper part of its water layer to a non-wet grain while in contact with it. Thus, a wetting action is initiated each time a wet grain contacts a non-wet one. If, on the other hand, the contaminant is present in a solution instead of being on a substrate, then shaking, preferably without the inclusion of air or other gases, will result in the formation of the membrane-like material into which the contaminant will be absorbed.

A particularly advantageous combination of solvents for use in the method according to the first aspect of the invention is hexane and methylene chloride. Indeed, since hexane has a density less than 1.0 and methylene chloride a density greater than 1.0, one can adjust the ratio of these two solvents so that when the hexane solution of contaminant and methylene chloride solution of membrane-like material forming component are combined, the combined solutions have a density less than 1.0. Thus, when the combined solutions, water and substrate are allowed to separate by relative densities following agitation, there will be formed a bottom layer of water on top of the substrate, a top layer of hexane and methylene chloride with the contaminant dissolved therein and an intermediate layer between the bottom and top layers, the intermediate layer consisting of a zone rich in the membrane-like material. Moreover, where the substrate is in granular form, traces of solvent dissolved in water entrapped in interstitial spaces between granules of the substrate, as well as any membrane-like material entrapped therein, can be removed in a final wash of the substrate with water introduced from below. This will cause the entrapped membrane-like material to be dislodged and to rise through the bottom layer of water to collect in the intermediate layer. Both the intermediate and top layers can thereafter be isolated and subjected to distillation for solvent recovery and disposal of the contaminant.

On the other hand, in the case where both the first and second solvents have densities greater than 1.0, it is preferable to wash the granular substrate with a solvent having a density less than 1.0, such as hexane, so as to remove traces of solvent in the water entrapped in interstitial spaces and, at the same time, gradually lower the density of the solution of contaminant until it moves above the water layer, the zone rich in membrane-like material collecting at the bottom of it and above the water layer which has been displaced downward. A final rinse with water may be necessary to flush out slight traces of hexane or other solvent used. Practically any non-polar solvent can be used to wash the granular substrate because the granules of the substrate will be covered with water constituting a hydration layer which surrounds each granule and will reject such solvents, effectively presenting the latter to contact the surface of the substrate.

When carrying out the method according to a second aspect of the invention, it is preferable to use solvents having densities greater than 1.0 such that when the separation takes place there are formed a bottom layer consisting of the mixture of solvents, a top layer of water and an intermediate layer between the bottom and top layers, the intermediate layer comprising the membrane-like material with absorbed contaminant. This will enable the membrane-like material to be conveniently removed through the top layer of water in which it is more stable. For instance, air can be blown into the bottom layer of solvents such that the air bubbles rise up through the intermediate layer comprising the membrane-like material with absorbed contaminant, thereby extending the latter into long tethers in the top layer of water from which the tethers may be gathered and removed by means of a wire brush.

The method of the invention is of course not limited to the removal of chlorine-based contaminants, but may also be used for removing crude or refined oils or bitumen from substrates covered with same, where there is a deficiency of the so-called membrane-like material forming component.

The present invention therefore provides, in a further aspect thereof, a method of separating oil or bitumen from a surface of a substrate covered with same, which comprises dissolving the oil or bitumen in a first solvent to form a solution thereof, separating the solution from the substrate to provide a solution wet substrate, and adding to the solution wet substrate a further solution consisting of a membrane-like material forming component derived from mineral crude oil, bitumen or amphipathic lipids in a second solvent selected from the group consisting of halogenated hydrocarbons and p-xylene, the second solvent being miscible with the first solvent and capable of forming in the presence of water and the membrane-like material forming component an interfacial membrane-like material which has a water side and is impermeable to the oil or bitumen. Water is then intimately contacted with the surface of the substrate so as to cause the membrane-like material to form at the surface of the substrate with the water side oriented toward the surface while the water wets the surface and spreads thereover, the membrane-like material incorporating during its formation the oil or bitumen and mixture of solvents adjacent the surface and the water displacing the membrane-like material away from the surface as it is being formed thereacross to thereby separate the oil or bitumen and mixture of solvents from the surface and cover the surface with a layer of water. The membrane-like material acts as a barrier to maintain the oil or bitumen in solution with the mixture of solvents and to prevent passage of same into the water layer.

Further features and advantages of the invention will become more readily apparent from the following description of experimental work and of the application of the method to the decontamination of dioxin contaminated soils as well as to the recovery of oil or bitumen from tar sands.

A first experiment was conducted to investigate the nature of the membrane-like material. A solution of methylene chloride and bitumen was placed in a beaker and water was admixed to form an interfacial membrane-like material. Bubbles of air were introduced from underneath so as to rise up through the membrane-like material and establish bubbles of air on tethers of membrane-like material extending a few millimeters in length. Additional bubbles were added below the membrane-like material, which were then caused to move to the bottom of a tether with a bubble above it. The lower bubble was then observed to distend the tether, and move up inside it to join the bubble at the top. The experiment showed that the tether was a flattened tube consisting of two sides face to face, and that the inner material, never exposed to water, but only to solvent, bitumen and air, remained separate and distinct. Thus, the membrane-like material has a water side and an oily side, each defining a surface. As long as the membrane-like material remains in the water, the material remains stable, but if it is removed through the air interface, it dissociates by loosing its solvent component. If it is disturbed as with fragments of membrane-like material settling loose on the surface of the membrane, these fragments eventually recombine with the membrane-like material.

A second experiment was performed to determine if the bitumen was responsible for the formation of the membrane-like material, together with the solvent and water, or if some specific component of the bitumen was responsible and to determine whether or not such a component was extractable. A quantity of bitumen was extracted with methylene chloride from a tar sand and left standing in a beaker for several weeks without the addition of water. The solvent gradually escaped and a skin formed on the surface of the bitumen. This skin layer was removed and saved. A sample of the bitumen material left after removal of the skin was added to methylene chloride and a water layer added on top. It was unexpectedly discovered that no membrane-like material could be formed. Only an interfacial film was formed, and the membrane-like material did not appear. Upon returning the skin layer to the bitumen and solvent solution with added water, the membrane-like material once again formed as before. Thus, a specific ingredient of the bitumen was found to be responsible for the formation of the membrane-like material.

A third experiment was made to determine if solvents, other than methylene chloride, and polar liquids other than water would operate in the practice of the invention. It was found that the following solvents or random combinations thereof would produce membrane-like material:

Methylene Chloride
Trichlorethylene
Chloroform
Perchlorethylene
Carbon tetrachloride
Trichlorofluoromethane
Dichlorodifluoromethane
FREON TF
p-Xylene On the other hand, it was found that the following solvents which are often disclosed in the art as being suitable for the solvent extraction of oil sand, tar sand, or oily compounds would not produce membrane-like material, but that these could be used as diluents prior to the formation of the membrane-like material, thus reducing the amount of the membrane-like material forming solvent from the above list that must be used:

Gasoline
Kerosene
Fuel Oil
Naptha
Ether
m-Xylene
o-Xylene
Hexane
Toluene

The isomers of xylene were unexpectedly found to be distributed between both the above lists.

It was also found that the following polar liquids would produce membrane-like material:

Water
Ethyl alcohol when used with the appropriate solvent and membrane-like material forming component, but the following would not:
Ammonia.

A fourth experiment was performed on a sample of oil saturated sand from Bakersfield Calif., where the clay fraction was later determined to be 40% by weight. The sand and clay were contacted with methylene chloride and agitated so as to bring the oil into solution with the solvent. Water was added slowly with a wand so as to form membrane-like material throughout the mass, and the excess water was allowed to collect on top. The sand and clay were carefully extracted from the bottom and were found to be water wet and oil free. It was found on several repeats of the experiment that an optimum concentration of solvent solution existed at which the membrane-like material would form, and then move through the mass of sand and clay as an interfacial zone. Too much solvent and the material was weak and would not separate cleanly from the sand, and particularly from the clay. Too little solvent and the interfacial zone would break up and form isolated regions enclosing sand, clay and oil. At the correct concentration of oil or bitumen, it has been found that the separation is clean and complete. This optimum concentration occurs when the concentration of oil or bitumen is low so that the solvent is nearly clear for this particular material. It was also found in several repeats of the experiment that if the sand mass was agitated the mass of sand increased in bulk due to the formation of membrane-like material forming globules which were then coalesced by applying moderate shearing forces to induce settling. If the introduction of the water from underneath was done sufficiently slowly, then such bulking could be avoided. Thus, it was confirmed that the membrane-like material did form with its water side towards the substrate. However, several failures of the experiment occured, indicating the need for further experiments.

A fifth experiment was performed to check if surfactants, used in the fourth experiment to clean the laboratory glassware, were interfering with the separation and causing the failures referred to in the fourth experiment. These surfactants are specifically those used for oily compound separation from surfaces by solubilization. The surfactants consist of an oil soluble part and a water soluble part, which may be anionic, cationic, zwitterionic or non-ionic. These parts are conventionally referred to as the heads, usually water soluble, and the tails, usually oil soluble. The fourth experiment was repeated with the same tar sand and oil sand but with the addition of the commercial surfactants commonly found in glassware cleaning formulations, such as ammonium lauryl sulphonate and sodium lauryl sulphonate. In all cases, the experiment failed, and an emulsion was formed. The following explanation was developed: The few layers of oily compound and solvent mixed with them that lie adjacent to the substrate form a convenient oil layer that allows the oil soluble tails of the surfactant to penetrate, leaving the water soluble surfactant heads exposed. Since the oily compound, now including the surfactant, is attached by coulombic forces to the substrate, and the surfactant is likewise held, the membrane-like material, if it forms at all, does so with its water side out and a water layer forms outside the oily layer, at a location determined by the surfactant heads thus effectively inhibiting the separation of oily compound from the substrate by preventing the water from reaching the substrate. Thick oily layers have been observed on the sand substrate, with the consequent loss of large amounts of solvent, when surfactants are present in even small amounts. Thus, the formation of the membrane-like material is inhibited by at least one observable mechanism, namely when surfactants are present. Upon repeating the fourth experiment, but taking care to eliminate surfactants, the failures referred to disappeared and the results became consistent with clean separations being achieved with a wide range of oily compound source material.

A sixth experiment was made to further define the properties of the membrane-like material in liquids, without the presence of a substrate. The conditions of the first experiment were repeated but with the separation of the membrane-like material effected by bubbling air through the interfacial zone so as to extend the membrane-like material into the water layer, and then using a wire brush to capture the material and deposit it into a vessel containing fresh solvent. Repeating the extraction from the fresh solvent several times resulted in a relatively concentrated material. This material was then added to fresh solvent, with a water layer added on top. The liquids were then shaken together and a zone of membrane-like material appeared at the top of the solvent layer and at the bottom of the water layer. It was unexpectedly discovered that all of the brown color, left over from the extraction and concentration of the material had been incorporated into the membrane-like material. After some minutes, the brown materials, residues of the original bitumen, diffused back into the solvent until nearly the original color was restored. This was unexpected. The mixture was shaken again, and this time the color was unexpectedly not taken up by the membrane-like material, but rather remained in the solvent. The formation of the membrane-like material thus involves a non-reversible step. Repeating the experiment with oil soluble dyes placed in the solvent showed the same effect; the dyes were first incorporated into the membrane-like material, and later at least partially released. A repeat of the experiment with dioxin showed similar results, that is, there was an affinity between the membrane-like material and dioxin; however, unlike the dyes, the dioxin remained absorbed in the membrane-like material.

A seventh experiment was performed to determine if the specific component derived from bitumen used in the second experiment and found to be responsible for the formation of the membrane-like material could be shown to exist in bitumen and crude oil from sources other than Athabasca. The extraction and test methods developed in the previous experiment were used. It was found by repeating the experiment that the membrane-like material forming component was present in oil or bitumen from the following sources: Athabasca, Venezuela and Utah at full strength relative to Athabasca. It was also present at slightly reduced strength in samples from New Mexico, Texas, Peru (South America) and Columbia (South America). It was also found in lesser strength in samples from Bakersfiled California. Additional samples of refined oil also showed the effect but with one notable exception, a refined oil from Pennsylvania did not shown any membrane-like material forming component.

An eight experiment was performed to determine the best method to be used to recover oil or bitumen from tar sand, together with the solvents used to recover it. First, a membrane-like material forming component was obtained as in the second experiment. Then, a sample of oil wet tar sand from Utah was extracted with kerosene as a solvent and most of the bitument was removed. Next, the membrane-like material forming component in a solution of methylene chloride was added and mixed thoroughly through the sand mass. Water was added slowly from the bottom so as to cause the membrane-like material to form adjacent the sand. Finally, the sand was washed several times with water and upon examination was found to be free of oil and solvents. An instrumentation examination of the water wet sand showed 19.9 parts per million of methylene chloride remaining, an extremely low value.

A ninth experiment was performed to determine if materials other than those extracted from crude oil or bitumen could be used to form membrane-like material. A quantity of cholesterol was added to methylene chloride and water was added on top. Upon shaking the mixture, the membrane-like material was found to have formed. It was thinner and weaker than that obtained from crude oil, but the extended structure was the same.

A tenth experiment was performed with a view to removing 2,3,7,8-tetrachlorodibenzo-p-dioxin (TCDD) from a sandy soil substrate contaminated with same. Unlike the earlier experiments, the amount of contaminant present was extremely small, of the order of 100 parts per billion. The maximum concentration of TCDD on any of the samples run in the experiment was 10 parts per million. These concentration levels contrast sharply with bitumen or oil samples previously run which have equivalent concentrations of 130,000 parts per million or 13%. The soil was first dried using heat and then 8.0 grams of the dry soil were placed in a separatory funnel; 15 ml of methylene chloride were added and the mixture was shaken. A solution of 250 ml of hexane and 50 ml of methylene chloride with membrane-like material forming component added, was made-up and tested for its activity to form membrane-like material of the desired strength. A few milliliters of the mixture was added to water in a flask and the mixture shaken. When the membrane-like material formed in a sufficient amount to produce at the interface between the water and methylene chloride a visible membrane strong enough to hold air bubbles 5 to 10 mm above the average membrane surface, the mixture was considered to be of sufficient strength. The ratio of hexane to methylene chloride was selected to produce a density of less than 1.0 when 30 ml of the solution was added to the mixture of soil and methylene chloride in the separatory funnel. The 30 ml of solution containing methylene chloride, hexane and membrane-like forming component were added to the separatory funnel, and the mixture shaken. About 50 ml of water were added and the mixture was shaken again. The separatory funnel was set aside for the contents to settle, and several layers formed. The solvent layer was on top, a zone rich in membrane-like material was at the bottom of the solvent layer, adjacent to the water layer underneath, and finally the soil was at the bottom. A sample of each of the layers was taken and analysed by the U.S. Environmental Protection Agency approved GC/MS/MS method for dioxin. Each sample was spiked with 10 ng of isotopically labelled $C_4^{37}$-2,3,7,8-TCDD and 50 ng of $C_{12}^{13}$-2,3,7,8-TCDD. The test results showed that the original TCDD and the isotopically labelled TCDD compounds could be reliably recovered from all of the samples, except the membrane-like material. No recovery was possible of either the original or the isotopically labelled TCDD from the membrane-like material. Using mass balance calculations, it was estimated that 53.7% of the original TCDD plus 100% of the two isotopically labelled TCDD compounds were absorbed in the membrane-like material. In another run, 42.9% of the original TCDD plus both isotopically labelled TCDD compounds were absorbed in the membrane-like material. The strong absorbtion of the dioxin by the membrane-like material was confirmed. The reduction in the TCDD concentration in the soil was from 79 parts per billion to 7.5 parts per billion.

I claim:

1. A method of preparing a membrane-like material forming component, which method comprises dissolving mineral crude oil, bitumen or an amphipathic lipid in a solvent to form a solution thereof, said solvent being selected from the group consisting of halogenated hydrocarbons and p-xylene and having the property of forming in the presence of water and said oil, bitumen or amphipathic lipid an interfacial membrane-like material, admixing water so as to cause said interfacial membrane-like material to form, allowing said solution, water and membrane-like material to separate by relative densities and to form a bottom layer of said solution, a top layer of water and an intermediate layer between said bottom and top layers, said intermediate layer comprising said membrane-like material, extending said membrane-like material into said top layer of water and thereafter isolating same therefrom, whereby said membrane-like material upon being brought into air dissociates and leaves a membrane-like material forming component derived from said oil, bitumen or amphipathic lipid and active to form membrane-like material, when recombined with said solvent and water.

2. A method as claimed in claim 1, wherein said solvent is selected from the group consisting of methylene chloride, chloroform, trichlorethylene, perchlorethylene, carbon tetrachloride, dichlorodifluoromethane, trichlorofluoromethane, trichlorotrifluoroethane and p-xylene.

3. A method as claimed in claim 2, wherein said solvent is methylene chloride.

4. A method as claimed in claim 1, wherein said membrane-like material is extended into said top layer of water by blowing air into said bottom layer of said solution and allowing air bubbles to rise up through said intermediate layer comprising said interfacial membrane-like material, thereby extending said membrane-like material into tethers in said top layer of water.

5. A method of forming a membrane-like material, which comprises the steps of:

(a) dissolving a membrane-like material forming component derived from mineral crude oil, bitumen or amphipathic lipids in a solvent to form a solution thereof, said solvent being selected from the group consisting of halogenated hydrocarbons and p-xylene and having the property of forming in the presence of water and said membrane-like material forming component an interfacial membrane-like material;

(b) intimately mixing the solution formed in step (a) with water so as to cause said interfacial membrane-like material to form; and (c) allowing the solution, water and membrane-like material to separate by relative densities and to form a bottom layer of said solution, a top layer of water and an intermediate layer between said bottom and top layers, said intermediate layer comprising said membrane-like material.

6. A method as claimed in claim 5, wherein said solvent is selected from the group consisting of methylene chloride, chloroform, trichlorethylene, perchlorethylene, carbon tetrachloride, dichlorodifluoromethane, trichlorofluoromethane, trichlorotrifluoroethane and p-xylene.

7. A method as claimed in claim 6, wherein said solvent is methylene chloride.

8. A method as claimed in claim 5, wherein step (b) is carried out by admixing water to said solution of membrane-like material forming component.

9. A method as claimed in claim 5, wherein said membrane-like material forming component is obtained by dissolving mineral crude oil, bitumen or an amphipathic lipid in a solvent to form a solution thereof, said solvent being selected from the group consisting of halogenated hydrocarbons and p-xylene and having the property of forming in the presence of water and said oil, bitumen or amphipathic lipid an interfacial membrane-like material, admixing water so as to cause said interfacial membrane-like material to form, allowing said solution, water and membrane-like material to separate by relative densities and to form a bottom layer of said solution, a top layer of water and an intermediate layer between said bottom and top layers, said intermediate layer comprising said membrane-like material, extending said membrane-like material into said top layer of water and thereafter isolating same therefrom, whereby said membrane-like material upon being brought into air dissociates and leaves a membrane-like material forming component derived from said oil, bitumen and amphipathic lipid and active to form membrane-like material, when recombined with said solvent and water.

* * * * *